US006794822B2

(12) United States Patent
Koga et al.

(10) Patent No.: US 6,794,822 B2
(45) Date of Patent: Sep. 21, 2004

(54) FIELD EMISSION ELECTRON SOURCE, ELECTRON GUN AND CATHODE RAY TUBE DEVICE USING THE SAME

(75) Inventors: Keisuke Koga, Kyoto (JP); Toru Kawase, Katano (JP); Masahide Yamauchi, Kyoto (JP); Koji Fujii, Kashihara (JP); Takashi Itoh, Amagasaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/293,539

(22) Filed: Nov. 12, 2002

(65) Prior Publication Data

US 2003/0098410 A1 May 29, 2003

(30) Foreign Application Priority Data

Nov. 13, 2001 (JP) ..... 2001-347462

(51) Int. Cl.[7] ..... H01J 23/08
(52) U.S. Cl. ..... 315/5.34; 315/368.15
(58) Field of Search ..... 315/5.34, 368.15, 315/368.16, 382, 382.1, 383, 364; H01J 23/08

(56) References Cited

U.S. PATENT DOCUMENTS 5,122,135 A * 6/1992 Durr et al. ..... 606/4
5,874,802 A * 2/1999 Choi et al. ..... 313/495
5,898,183 A * 4/1999 Teder ..... 250/574
5,981,303 A 11/1999 Gilton ..... 438/20
6,313,815 B1 11/2001 Takeda et al. ..... 345/75.2
6,394,871 B2 5/2002 Lee ..... 445/24
6,417,016 B1 7/2002 Gilton et al. ..... 438/20

FOREIGN PATENT DOCUMENTS

JP 48-90467 * 11/1973
JP 5-12986 1/1993 ..... H01J/1/30
JP 9-204880 8/1997 ..... H01J/29/48

* cited by examiner

*Primary Examiner*—Don Wong
*Assistant Examiner*—Trinh Vo Dinh
(74) *Attorney, Agent, or Firm*—Merchant & Gould P.C.

(57) ABSTRACT

A field emission electron source includes: a field emission array portion composed of an insulation layer with a plurality of apertures, which is formed on a substrate, an extraction electrode formed on the insulation layer, and a plurality of cathodes formed respectively on the substrate in the plurality of apertures; a cathode base for fixing the field emission array portion; and an electron lens portion composed of a plurality of electrode members having a function of accelerating and converging an electron beam emitted from the field emission array portion. An emission axis of the electron beam emitted from the field emission array portion has a predetermined angle with respect to an optical axis of the electron lens portion. Thus, the field emission array portion can be protected from impact caused by ions generated in the electron lens portion, thereby improving the life of a field emission electron source.

8 Claims, 4 Drawing Sheets

FIELD EMISSION ELECTRON SOURCE, ELECTRON GUN AND CATHODE RAY TUBE DEVICE USING THE SAME

BACKGROUND OF THE INVENTION

1. Field of the Invention

The present invention relates generally to a cathode ray tube (hereinafter, abbreviated as CRT) for color televisions or high-definition monitor televisions. Specifically, this invention relates to a field emission electron source that can be used as a cathode of an electron gun used in a high-luminance CRT requiring high current density, or an electron gun used in, for example, an electron beam exposure device utilizing converged electron beams.

2. Related Background Art

In recent years, with the introduction of thin-type displays such as a liquid crystal display, a plasma display and the like, the market of flat panel displays has been expanding rapidly. Even with such a trend, for home-use television sets with a size of about 32-inch diagonal, displays using CRTs still have been in the highest demand in terms of their prices and performances. Furthermore, terrestrial digital broadcasting is planned to be newly introduced at full scale starting from the year 2003, and therefore it is expected that there will be a drastic change in the technologies of television displays. With televisions and their surroundings making a transition to a digital system, displays have been required strongly to have high resolution performance. However, there has arisen a possibility that such requirement might not be met satisfactorily by conventional television technologies that have been in wide use.

In a CRT, an electron gun is used as a core portion for displaying images, and the performance of the electron gun strongly affects resolution performance. When a cathode used in an electron gun has increased current density, an effective cathode area can be reduced, thereby allowing the resolution performance to be improved. Thermal cathode materials currently used as cathodes have undergone various technological improvements so as to have improved current density. The thermal cathode materials are now approaching their physical limitations and are reaching a difficult situation where no further remarkable improvements in current density can be made. In recent years, a cathode for electron guns used for digital broadcasting has been going into practical use. Such a cathode has been requested to have an improved current density by a factor of about 6 to 10 than of a conventional thermal cathode.

Meanwhile, a conception regarding the use of a cold cathode in an electron gun has been proposed conventionally. A cold cathode has an inherent advantage of its high current density, and thus conventionally, some products of the cold cathode such as an electron microscope have become commercially practical.

As a first example of a cold cathode used in a CRT, JP48(1973)-90467 A discloses a conception regarding a color picture tube using a field emission cathode. In addition to the above-described advantage of the high current density, when used in a color picture tube, a field emission cathode can provide an advantage in its suitability for achieving lower power consumption. When a conventional thermal cathode is used, the use of a heater is required for electron emission. This entails a standby power consumption of about several watts on a constant basis even during a period in which the electron gun is not operated. In contrast to this, when a field emission cathode is used, a heater is not required at all. This can provide not only the advantage of suppressing unnecessary power consumption but also the advantage of allowing an electron gun to be started instantaneously.

FIG. 6 is a cross sectional view of a field emission electron source disclosed in JP48(1973)-90467 A. Cathodes 61R, 61G and 61B provided on a substrate 60 are formed of three pieces or three groups of conical cathode projections 62. The cathodes 61R, 61G and 61B are insulated from each other by an insulation layer 63, and supplied with luminance signals for red (R), green (G) and blue (B), respectively. A gate electrode 64 formed of a thin metallic film with apertures corresponding to the respective cathode projections 62 is supplied with an appropriate potential such that a predetermined field emission current is generated from each of the cathode projections 62 when the luminance signals are applied to the cathodes 61R, 61G and 61B, respectively. A control electrode 66 is disposed on the gate electrode 64 through an insulation layer 65. After being transmitted through the control electrode 66, an emitted electron beam travels in the same path as that in a conventional electron gun to be focused on a screen. This configuration has enabled a high current density operation that conventional cathodes have failed to realize and allowed high luminance and high resolution properties to be attained.

However, with the future spread of digital high-definition television broadcasting, there will be an increasing demand for CRTs that can achieve a resolution not less than two times as high as that in the case of conventional broadcasting. Generally, because of an operation principle of the CRTs, the closer to a peripheral portion of a screen a beam spot of an electron beam is, and the higher the luminance of the screen is, the more distorted in shape the beam spot is. This causes the resolution of the screen to be deteriorated. For the improvement in resolution of a CRT, this can be addressed effectively, for example, by further improving the CRT in current density. However, because of a close relationship between the current density of a cathode and the life of the cathode, an increase in current density causes the life to be decreased. Thus, from a practical viewpoint, there is a limit to the degree to which the current density can be increased.

Generally, as materials of cold cathode elements, metals having high melting points such as molybdenum and the like often are used in such cold cathodes. Further, because of a constraint of a manufacturing process, a CRT tube as a finished product manufactured by the CRT manufacturing process has a vacuum of about $10^{-5}$ Pa in the tube. When a cold cathode was operated at a current density of about 10 $A/cm^2$ under the condition of this vacuum, the following problem arose. That is, in the tube of the CRT, there exist molecules of various kinds of residual gases generated in the manufacturing process and an electron beam emitted from the cold cathode collides with those molecules, so that a large number of ions were generated. Our evaluation test has revealed that these ions thus generated are accelerated and collide against a surface of a cold cathode element of the cold cathode, so that the cold cathode element is damaged, and thus a beam current emitted from the cathode is lowered substantially. When the cold cathode is applied to an electron gun for televisions, this lowering of a beam current emitted from the cold cathode results in a decrease in luminance of a CRT screen. Accordingly, a desired luminance cannot be maintained during long-term use, which is a serious problem.

A mechanism of this ion generation is considered to be such that an electron beam accelerated and converged to about 100 eV by an electric field in the vicinity of the cold cathode collides with a gas molecule remaining near the cold cathode. An amount of ions to be generated is proportional to a vacuum level and a current density. Therefore, in order to suppress the ion generation, a method to be selected has been an improvement of vacuum level or a decrease of the current density. Because of a constraint of the CRT manufacturing process, it is difficult to improve the vacuum level considerably. Also, the degree of increasing the current density for the improvement in resolution is limited to such a range as to allow the service lives of these elements to be secured. Thus, a sufficient resolution has not been realized to date.

SUMMARY OF THE INVENTION

It is an object of the present invention to provide a field emission electron source that can prevent a lowering of current even in a long-term operation at a high current density and enables a stable operation even at a high current density.

A field emission electron source according to the present invention includes a field emission array portion composed of an insulation layer with a plurality of apertures, which is formed on a substrate, an extraction electrode formed on the insulation layer, and a plurality of cathodes formed respectively on the substrate in the plurality of apertures. The field emission electron source further includes a cathode base for fixing the field emission array portion, and an electron lens portion composed of a plurality of electrode members having a function of accelerating and converging an electron beam emitted from the field emission array portion. In order to solve the aforementioned problem, an emission axis of the electron beam emitted from the field emission array portion has a predetermined angle with respect to an optical axis of the electron lens portion.

According to this configuration, the emission axis of an electron beam emitted from a field emission electron source is set to be shifted from the optical axis of the electron lens portion, so that the field emission electron source can be protected from ion impact caused by ions generated mainly in the electron lens portion. Thus, this configuration is suitable for improving the life of the field emission electron source.

The above-mentioned field emission electron source can be configured in the following manner. That is, in the field emission electron source, a cathode fixing surface inclined at the predetermined angle with respect to a surface of the cathode base is provided on a portion of the surface of the cathode base, and the field emission array portion is attached on the cathode fixing surface. According to this configuration, a predetermined off-axis angle can be set by using an inclined surface formed on the cathode base, thereby allowing an off-axis system to be set with high accuracy so as to have an arbitrary off-axis angle.

Preferably, a positioning mark is provided in either or both of the surface of the cathode base and a surface of the substrate. According to this configuration, the positioning of the substrate relative to the cathode base can be performed with high accuracy, and the influence of beam distortion caused by a positioning error can be reduced, thereby contributing more to the improvement in resolution.

Furthermore, preferably, at least a part of the electron lens portion has a function of deflecting an angle of the emission axis of the electron beam emitted from the field emission array portion so that the angle of the emission axis coincides with the optical axis of the electron lens portion. According to this configuration, the optical axis can be adjusted by applying a voltage to the electron lens portion, thereby allowing an electron lens to be designed more freely.

Furthermore, preferably, an electron emitting region of the field emission array portion is disposed in a shielding region that faces a non-aperture region of a first electrode member among the plurality of electrode members constituting the electron lens portion. The first electrode member is arranged closest to the field emission array portion. According to this configuration, the field emission electron source can be protected more completely from ion impact caused by ions generated mainly in the electron lens portion.

The above-mentioned field emission electron source can be configured in the following manner. That is, an optical axis of an electrode member among the plurality of electrode members constituting the electron lens portion has a predetermined angle with respect to the emission axis of the electron beam emitted from the field emission array portion. The electrode member is arranged closest to the field emission array portion An electron gun can be configured using a field emission electron source of any one of the above-mentioned configurations. According to this configuration, an electron gun can be provided that can be used in a high-luminance CRT requiring a high current density.

A display device, an image display device or a cathode ray tube device can be configured by the inclusion of the above-mentioned electron gun and a unit for deflecting an electron beam emitted from the electron gun in a vacuum container. According to this configuration, the field emission electron source that can protect the field emission array portion from ion impact is used as a cathode of the electron gun, thereby allowing a cathode ray tube device having an excellent life time property to be obtained.

DETAILED DESCRIPTION OF THE INVENTION

Embodiment 1

Hereinafter, a structure of a field emission electron source according to Embodiment 1 of the present invention will be described with reference to FIG. 1. This figure shows the element for obtaining a single electron beam.

Figure 1:
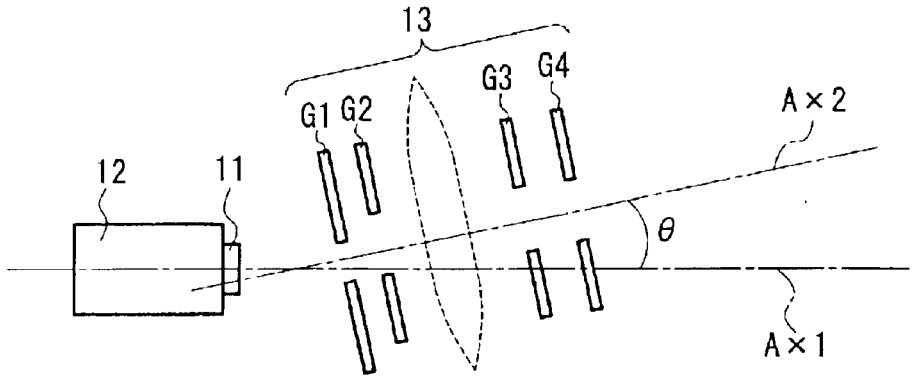
FIG. 1 is a front view showing a configuration of a field emission electron source according to Embodiment 1 of the present invention.

Basically, the field emission electron source shown in FIG. 1 includes a substrate 11, a cathode base 12 for fixing the substrate 11, and an electron lens portion 13. Afield emission array portion (not shown) composed of a plurality of cathodes is formed on the substrate 11. The electron lens portion 13 is formed of a combination of a plurality of grid electrodes G1 to G4, each formed of an electrode member. The grid electrodes G1 to G4 have a function of accelerating and converging an electron beam emitted from the field emission array portion, and define a component of an electron gun.

Figure 6:
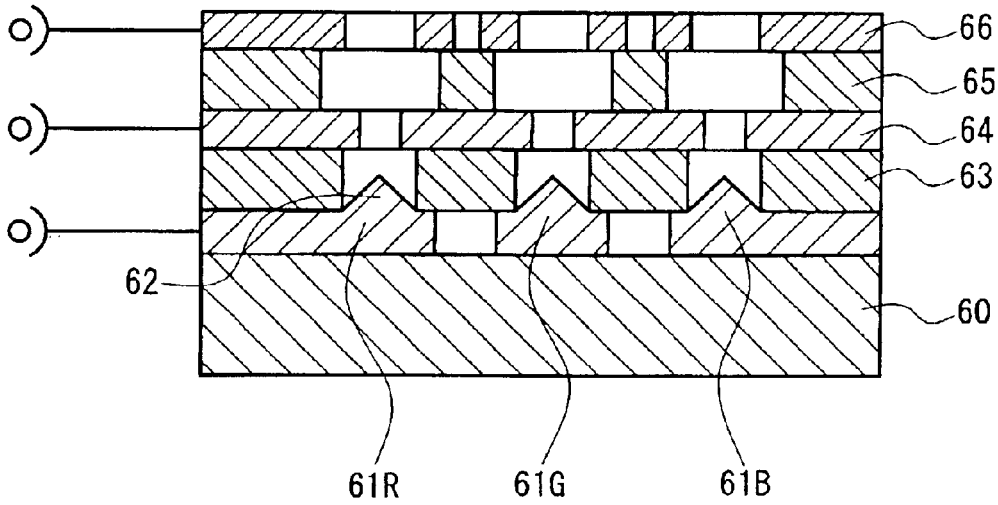
FIG. 6 PRIOR ART
FIG. 6 is a cross-sectional view of a conventional field emission electron source.

The field emission array portion formed on the substrate 11 has the same structure as that shown in FIG. 6. That is, an electron emitting portion is formed on each of array-like cathode-forming regions on the substrate 11. An extraction electrode for controlling electron emission through an insulation layer with circular apertures is formed above the electron emitting portions. The field emission array portion composed of a plurality of the above-described electron emitting portions is formed on a whole or a predetermined partial region of the substrate 11.

The substrate 11 can be formed of an optimum material selected from conventionally-used materials such as a glass substrate, a silicon substrate and the like, taking into consideration the properties and process conditions of an electron source provided in each of the electron emitting portions. Further, although the description does not particularly go into details on a material and a structure of the electron emitting portion, for example, a conventionally-used Spindt-type electron source formed by vapor deposition of molybdenum, a silicon electron source formed by utilizing a silicon semiconductor process or the like can be used. The substrate 11 is fixed to the cathode base 12 by using a conductive adhesive or the like, after the substrate 11 is positioned on a surface of the cathode base 12 with predetermined accuracy.

The electron lens portion 13 formed of the combination of the grid electrodes G1 to G4, which is arranged adjacently to an upper portion of the substrate 11 (right side in FIG. 1), is arranged so that the electron lens portion 13 and the substrate 11 are opposed at a fixed distance from each other. The grid electrodes G1 to G4 are supplied with the respective optimum voltages so as to accelerate and converge an electron beam emitted from the field emission array portion formed on the substrate 11.

Generally, the electron beam is emitted from the field emission array portion in a direction of an emission axis (A×1) perpendicular to a surface of the substrate 11. An optical axis (A×2) of the electron lens portion 13 is arranged in an off-axis state so as to have a predetermined angle (θ) with respect to the emission axis (A×1). The optical axis of the electron lens portion 13 is defined as an axis corresponding to an optical axis of an optical lens, where an effect on the electron beam caused by an electrostatic lens formed by a potential difference between the grid electrodes G1 to G4 constituting the electron lens portion 13 corresponds to an effect on light caused by the optical lens.

At least a part of a lens configuration of the electron lens portion 13 may have a function of deflecting an angle of the emission axis (A×1) of an electron beam emitted from the field emission electron source so that the angle coincides with the optical axis (A×2) of the electron lens portion. This deflecting function can be obtained by adjusting two electrodes selected from the grid electrodes G1 to G4 constituting the electron lens portion 13. In principle, the two electrodes may be any of the above electrodes. However, preferably, the grid electrodes G1 and G2 are used to form a lens configuration for providing the deflecting function for the following reason: the grid electrode with a smaller potential is more advantageous in performing deflection; or the closer to the field emission array portion the grid electrode is, the more reduced ion impact caused in the electron lens portion can be. Specifically, for example, a center position of each aperture of the grid electrodes G1 and G2 is shifted by a proper amount in an aperture diameter direction, and a predetermined relative potential difference is applied to each of the above electrodes, so that the electrodes are allowed to have the deflecting function.

Next, a mechanism of how the field emission electron source according to this embodiment contributes to an improvement in life will be described briefly.

As described with regard to the problem in the conventional technique, a CRT as a finished product manufactured by the CRT manufacturing process has a vacuum of about $10^{-5}$ Pa in the tube because of the constraints of the manufacturing process. When the electron beam emitted from the field emission array portion is operated at a condition of a high current density of about 10 A/cm$^2$, high-energy irons are generated in the CRT tube or the electron lens portion 13. That is, molecules of various kinds of residual gases generated in the manufacturing process exist in the CRT tube and the electron beam emitted from the field emission array portion collides with those molecules, so that a large number of high-energy ions are generated. In the conventional technique, an emission axis (A×1) of a beam current coincides with an optical axis (A×2) of an electron lens portion, and thus many of the generated high-energy ions reach a surface of a field emission array portion, and their direct impact on the field emission array portion causes damage thereto. Because of this damage due to the ion impact, an electron emitting property of the field emission array portion is deteriorated considerably. This has led to problems such as lowering of a beam current and the like.

In a configuration of the field emission electron source according to this embodiment, the optical axis (A×2) of the electron lens portion is set to be in an off-axis state with respect to the emission axis (A×1) of a beam current. High-energy ions generated in the CRT tube, particularly, in the electron lens portion 13 in which the ions cause the greatest influence, are accelerated along a direction of the optical axis (A×2) of the electron lens portion. Since an ion has a property of traveling straight, the high-energy ions hardly reach an electron emission region in the field emission array portion. As a result, the electron emitting property of the field emission array portion hardly is damaged by ion impact, thereby allowing a stable operation to be performed for a long period of time.

An off-axis angle (θ) should be set to be optimum in consideration of an operational area of the field emission array portion and a distance to the electron lens portion. In order to attain a sufficient effect of preventing the field emission array portion from being damaged by ion impact while suppressing the generation of aberration in the electron lens portion, preferably, the angle (θ) is set to be about 2° under general conditions.

As described above, according to the field emission electron source of this embodiment, the emission axis of an electron beam emitted from a field emission electron source is set to be shifted from the optical axis of an electron lens. Thus, the field emission electron source can be protected from ion impact caused by ions generated mainly in the electron lens portion, thereby allowing the field emission electron source to have improved life.

The foregoing description is directed to a case where an electron source element according to this embodiment is used in a CRT as a typical application. However, the applications of the present invention are not limited to the CRT. The present invention is also applicable to other applications, for example, in a high-luminance light-emitting display tube for field display, a light-emitting tube for illumination, an electron beam exposure device and the like.

Embodiment 2

Figure 2A:
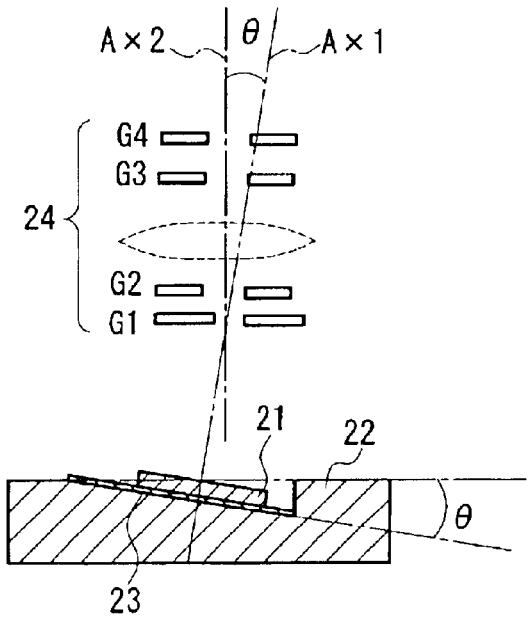
FIG. 2A is a cross-sectional view showing a configuration of a field emission electron source according to Embodiment 2 of the present invention.
Figure 2B:
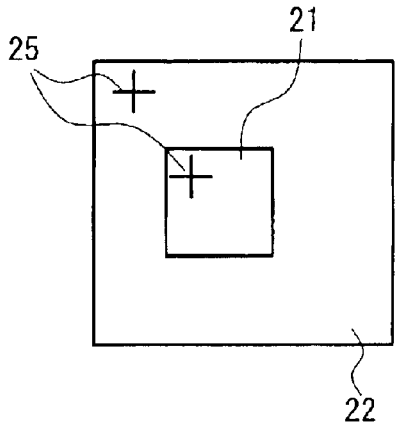
FIG. 2B is a plan view showing the configuration of the field emission electron source according to Embodiment 2 of the present invention.

Hereinafter, a structure of a field emission electron source according to Embodiment 2 of the present invention will be described with reference to FIGS. 2A and 2B.

A basic configuration of this field emission electron source is the same as that of the field emission electron source according to Embodiment 1. That is, the field emission electron source includes a substrate 21 on which a field emission array portion is formed, a cathode base 22 on which the substrate 21 is fixed, and an electron lens portion 24 formed of a combination of grid electrodes G1 to G4. However, the cathode base 22 has a structure different from that in Embodiment 1. A cathode fixing surface 23 inclined at a predetermined angle (θ) with respect to a surface of the cathode base 22 is provided on a portion of the surface of the cathode base 22, and the substrate 21 is provided on the cathode fixing surface 23.

The field emission array portion formed on the substrate 21 has the same structure as that shown in FIG. 6. That is, an electron emitting portion is formed on each of array-like cathode-forming regions on the substrate 21. An extraction electrode for controlling electron emission through an insulation layer with circular apertures is formed above the electron emitting portions. The field emission array portion composed of a plurality of the above-described electron emitting portions is formed on a whole or a predetermined partial region of the substrate 21.

The substrate 21 can be formed of an optimum material selected from conventionally-used materials such as a glass substrate, a silicon substrate and the like, taking into consideration the properties and process conditions of an electron source provided in each of the electron emitting portions. Further, although the description does not particularly go into details on a material and a structure of the electron emitting portion, for example, a conventionally-used Spindt-type electron source formed by vapor deposition of molybdenum, a silicon electron source formed by utilizing the silicon semiconductor process or the like can be used.

The electron lens portion 24 formed of a combination of the grid electrodes G1 to G4 is arranged adjacently to an upper portion of the cathode base 22 on which the substrate 21 is fixed. The electron lens portion 24 is arranged so that the electron lens portion 24 and the surface of the cathode base 22, on which the cathode fixing surface 23 is provided, are opposed at a fixed distance from each other. The grid electrodes G1 to G4 are supplied with the respective optimum voltages so as to accelerate and converge an electron beam emitted from the field emission array portion formed on the substrate 21.

The cathode fixing surface 23 is provided on at least a partial region of the surface of the cathode base 22. The substrate 21 on which the field emission array portion is formed is fixed to the cathode base 22 by using a conductive adhesive or the like, after the substrate 21 is positioned on the cathode fixing surface 23 on the cathode base 22 with predetermined accuracy.

Positioning marks 25 for automatically positioning the substrate 21 with respect to the cathode base 22 are formed on the respective surfaces of the cathode base 22 and the substrate 21. For being adopted to an image recognizing device in general use, the positioning marks 25 can be formed so as to have an appropriate shape according to the accuracy required. The positioning mark 25 can be, for example, a groove-like cross mark having a width of 10 microns and a length of about 100 microns. By the use of an automatic positioning detection device, relative positioning can be performed with constant accuracy regardless of variations in the shape of the cathode base 22 and the substrate 21. When a field emission array portion according to this embodiment is used as a cathode for an electron gun, positioning accuracy with respect to the electric lens portion 24 is required to be not more than 5 microns.

Generally, an emission axis (A×1) of the electron beam emitted from the field emission array portion is perpendicular to the surface of the substrate 21. In this embodiment, the substrate 21 is fixed on the cathode fixing surface 23 inclined at a predetermined angle with respect to the surface of the cathode base 22, and thus automatically, the electron beam is emitted in a direction inclined by an angle θ with respect to a direction perpendicular to the cathode base 22. With this configuration, when mechanically assembling the cathode base 22 and the electron lens portion 24, a conventional assembling method can be used without considering the beam emission axis (A×1).

At least a part of a lens configuration of the electron lens portion 24, for example, the lens configuration of the grid electrodes G1 and G2, may have a function of deflecting an angle of the emission axis (A×1) of an electron beam emitted from the field emission electron source so that the angle coincides with an optical axis (A×2) of the electron lens portion 24. Specifically, a center position of each aperture of the grid electrodes G1 and G2 is shifted by a proper amount in an aperture diameter direction, and a predetermined relative potential difference is applied to each of the above electrodes, so that the electrodes are allowed to have the deflecting function.

Next, a mechanism of how the field emission electron source according to this embodiment contributes to an improvement in life will be described briefly.

In a configuration of the field emission electron source according to this embodiment, the cathode fixing surface 23 inclined at a predetermined angle with respect to the surface of the cathode base 22 is provided on a portion of the surface of the cathode base 22, and the substrate 21 with a field emission electron source array is attached on the cathode fixing surface 23. Thus, in the same manner as in Embodiment 1, the optical axis (A×2) of the electron lens portion is set to be in an off-axis state at a predetermined angle (θ) with respect to the emission axis (A×1) of the electron beam. High-energy ions generated in a CRT tube, particularly, in the electron lens portion 24 in which the ions cause the greatest influence, are accelerated along a direction of the optical axis (A×2) of the electron lens portion. Since an ion has a property of traveling straight, the high-energy ions hardly reach an electron emission region in the field emission array portion. As a result, an electron emitting property of the field emission array portion hardly is damaged by ion impact, thereby allowing a stable operation to be performed for a long period of time.

Furthermore, since the emission axis (A×1) of an electron beam can be set based on an inclination angle (θ) of the cathode fixing surface 23 formed on the cathode base 22, manufacturing can be performed without changing the conventional mechanical assembling method. Thus, the field emission electron source according to this embodiment can be manufactured without incurring a new investment in equipment or the like.

As described above, according to the field emission electron source of Embodiment 2, the emission axis (A×1) of an electron beam emitted from a field emission electron source can be set to be shifted from the optical axis (A×2) of an electron lens. Thus, the field emission electron source can be protected from ion impact caused by ions generated mainly in the electron lens portion 24, thereby allowing the field emission electron source to be improved in life. Further, manufacturing can be performed without changing the conventional mechanical assembling method, thereby providing a substantial effect in terms of a production cost from a practical viewpoint.

The foregoing description is directed to a case where the electron source according to this embodiment is used in a CRT as a typical application. However, the applications of the present invention are not limited to the CRT. The present invention is also applicable to other applications, for example, in a high-luminance light-emitting display tube for field display, a light-emitting tube for illumination, an electron beam exposure device and the like.

Embodiment 3

Figure 3A:
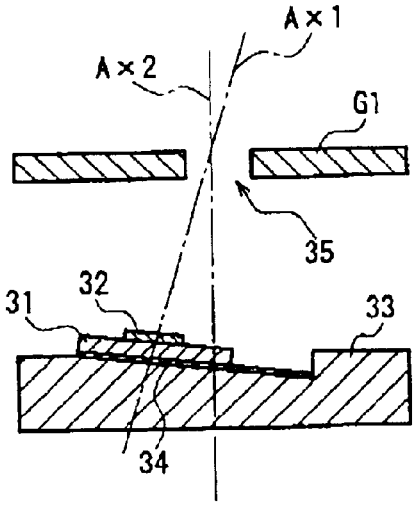
FIG. 3A is a cross-sectional view showing a configuration of a field emission electron source according to Embodiment 3 of the present invention.
Figure 3B:
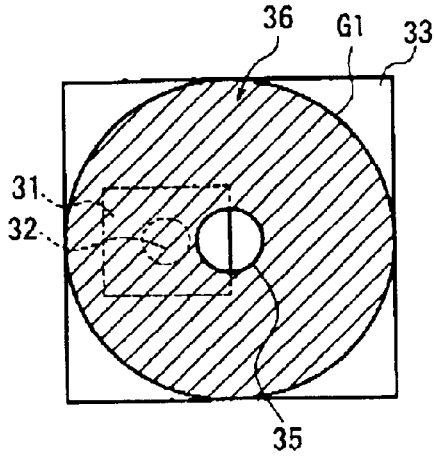
FIG. 3B is a plan view showing the configuration of the field emission electron source according to Embodiment 3 of the present invention.

Hereinafter, a structure of a field emission electron source according to Embodiment 3 of the present invention will be described with reference to FIGS. 3A and 3B.

The basic configuration of this field emission electron source is the same as that of the field emission electron source described with regard to Embodiment 2. That is, a cathode fixing surface 34 inclined at a predetermined angle (θ) with respect to a surface of a cathode base 33 is formed on a portion of the surface of the cathode base 33. A substrate 31 on which a field emission array portion 32 is formed is fixed on the cathode fixing surface 34. Although in the figures, only a grid electrode G1 is shown, an electron lens portion formed of a combination of a plurality of grid electrodes is provided.

The configuration according to this embodiment is characterized by an arrangement of the grid electrode G1, which is positioned closest to the field emission array portion 32, among the plurality of grid electrodes constituting an electron lens portion. That is, in a relative positional relationship between an aperture 35 of the grid electrode G1 and an electron emitting region of the field emission array portion 32, the electron emitting region is arranged so as to face a non-aperture region 36 (shielding region: indicated by cross-hatch in FIG. 3B) of the grid electrode G1. In the following description, elements specific to this embodiment will be described in detail. The non-aperture region is defined as a region of the grid electrode G1 in which the aperture 35 is not formed.

The field emission array portion 32 formed on the substrate 31 has the same structure as that shown in FIG. 6. That is, an electron emitting portion is formed on each of array-like cathode-forming regions on the substrate 31. An extraction electrode for controlling electron emission though an insulation layer with circular apertures is formed above the electron emitting portions. The field emission array portion 32 composed of a plurality of the above-mentioned electron emitting portions is formed on a whole or a predetermined partial region of a surface of the substrate 31.

The substrate 31 can be formed of an optimum material selected from conventionally-used materials such as a glass substrate, a silicon substrate and the like, taking into consideration the properties and process conditions of an electron source provided in each of the electron emitting portions. Further, although the description does not particularly go into details on a material and a structure of the electron emitting portion, for example, a conventionally-used Spindt-type electron source formed by vapor deposition of molybdenum, a silicon electron source formed by utilizing the silicon semiconductor process or the like can be used.

The cathode fixing surface 34 is provided at least on a partial region of the surface of the cathode base 33. The substrate 31 on which the field emission array portion 32 is formed is fixed to the cathode base 33 by using a conductive adhesive or the like, after the substrate 31 is positioned on the cathode fixing surface 34 on the surface of the cathode base 33 with a predetermined accuracy.

Above the substrate 31, the grid electrode G1 constituting the electron lens portion as a component of an electron gun is arranged so that the substrate 31 and the cathode base 33 are opposed at a fixed distance from each other. The relative positional relationship between the grid electrode G1 and the electron emitting region of the field emission array portion 32 is set so that the electron emitting region is positioned so as to oppose the non-aperture region (shielding region) of the grid electrode G1.

High-energy ions generated in a CRT tube particularly, in the electron lens portion in which the ions have the greatest influence, are accelerated along a direction of the optical axis (A×2) of the electron lens portion. Since an ion has a property of traveling straight, the high-energy ions are blocked off completely at a surface of the grid electrode G1 because of the above-mentioned relative positional relationship between the grid electrode G1 and the field emission array portion 32, and thus hardly reach the electron emitting region of the field emission array portion 32. Therefore, in addition to the effect described with regard to Embodiments 1 and 2 by which ion impact can be reduced by an off-axis system, another effect can be provided, by which the high-energy ions are blocked off completely by the grid electrode G1 in the vicinity of the field emission array portion 32. Thus, an electron emitting property of the field emission array portion 32 is prevented more completely from being damaged, thereby allowing a stable operation to be performed for a long period of time.

As described above, particularly when used as a cathode for an electron gun of a CRT, the field emission electron source according to Embodiment 3 allows a stable operation to be performed for a long period of time without being subjected to ion impact, because of the arrangement in which the electron emitting region faces the non-aperture region (shielding region) of the grid electrode G1.

The foregoing description is directed to a case where an electron source according to this embodiment is used in a CRT as a typical application. However, the applications of the present invention are not limited to the CRT. The present invention is also applicable to other applications, for example, in a high-luminance light-emitting display tube for field display, a light-emitting tube for illumination, an electron beam exposure device and the like.

Embodiment 4

Hereinafter, a structure of a cathode ray tube device according to Embodiment 4 of the present invention will be described with reference to FIG. 4. In this cathode ray tube device, an electron beam 44 emitted from an electron gun 43 housed in a neck 42 of a bulb (vacuum container) 41 is deflected by a deflection yoke 46 attached to an outer periphery in a funnel 45. The electron beam 44 is irradiated onto a phosphor screen 48 attached to an inner surface of a face panel 47, so that an image is formed on the face panel 47. At least one of the configurations of the field emission electron source according to Embodiments 1 to 3 is used as a configuration of the electron gun 43.

In the following description, a function of shielding a field emission electron source from ion impact in this cathode ray tube device is explained specifically with reference to FIG. 5.

Figure 4:
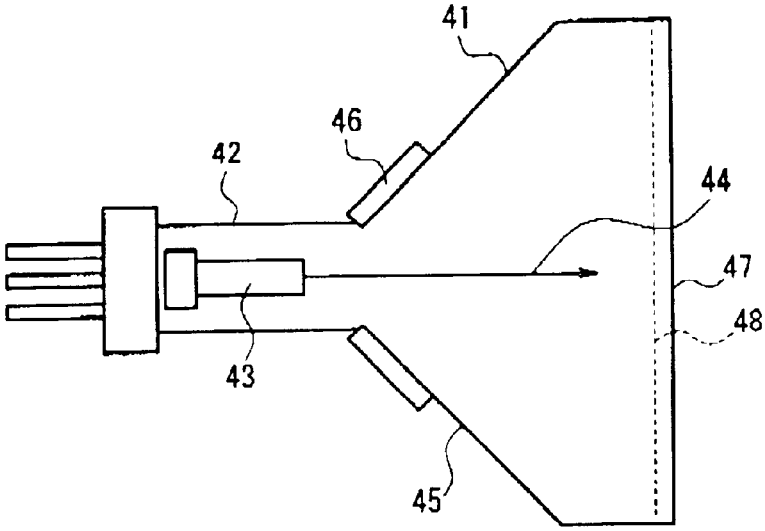
FIG. 4 is a cross-sectional view showing a configuration of a cathode ray tube device according to Embodiment 4 of the present invention.
Figure 5:
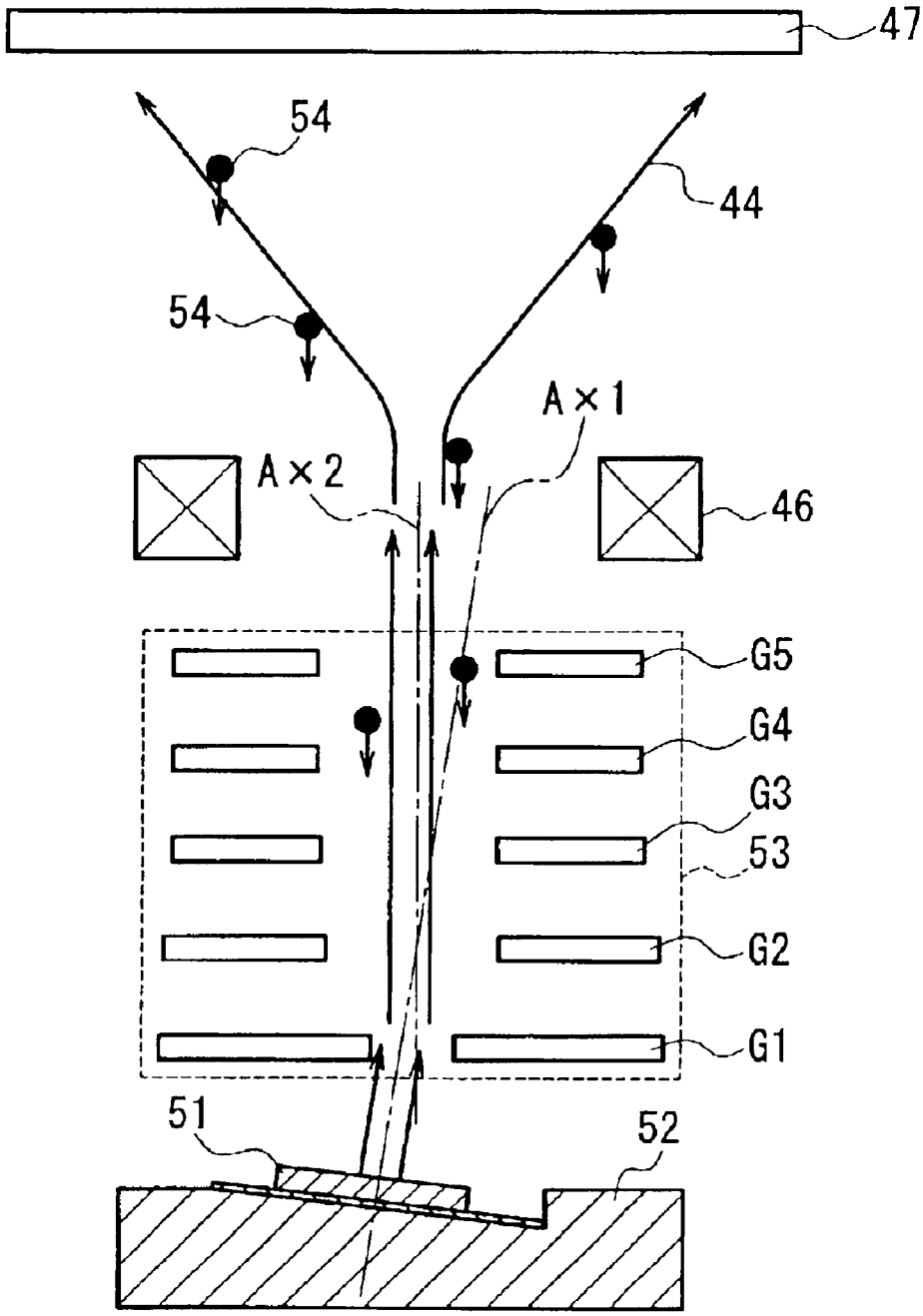
FIG. 5 is a cross-sectional view showing a configuration of an electron gun in the cathode ray tube device shown in FIG. 4.

FIG. 5 shows in detail a portion of the electron gun 43 in a display device shown in FIG. 4. As shown in the figure, a field emission array portion 51 is fixed on a cathode base 52. An electron lens portion 53 formed of a combination of grid electrodes G1 to G5 as those described in Embodiments 1 to 3 is arranged in a position opposing a vicinity of the field emission array portion 51. The grid electrodes G1 to G5 are supplied with the respective optimum voltages so as to accelerate and converge an electron beam 44 emitted from the field emission array portion 51. The electron beam 44 transmitted through the electron lens portion 53 is subjected to an effect of a deflection magnetic field of the deflection yoke 46 and irradiated onto the phosphor screen 48 of the face panel 47, so that a desired image can be formed.

With respect to a potential of the cathode base 52, extremely high voltages of about 500 V and about 30 KV are applied to the grid electrode G2 in the vicinity of the cathode base 52 and each of the grid electrodes G4 and G5 in a main lens portion, respectively. An electron beam emitted from the field emission array portion 51 collides with a residual gas in an inner portion of the electron gun or a tube of a CRT, and thus a large amount of ions 54 are generated. Of these ions 54, the positively charged ion 54 is affected by an electric field in the electron gun or the tube of the CRT, and travels toward the field emission array portion 51 while being accelerated to a maximum of about 30 KV.

However, in the case of the field emission electron source according to the present invention, an optical axis (A×2) of the electron lens portion and an emission axis (A×1) of the electron beam 44 are arranged in an off-axis state. Thus, most of high-energy ions that have traveled in the direction of the optical axis (A×2) of an electron lens are shielded by the grid electrode G1 and prevented from traveling to a surface of the field emission array portion 51.

Furthermore, as in the configuration according to Embodiment 3, when an electron emitting region of the field emission array portion 51 is arranged so as to face a non-aperture region (shielding region) of the grid electrode G1, a shielding effect at a surface of the grid electrode 51 is enhanced. Thus, the high-energy ions hardly reach the electron emitting region of the field emission array portion 51. As a result, an electron emitting property of the field emission array portion 51 is prevented from being damaged, thereby allowing a stable operation to be performed for a long period of time.

As described above, the cathode ray tube device according to Embodiment 4 allows the surface of the field emission array portion 51 to be prevented from being damaged by ion impact caused by high-energy ions generated in the electron gun 43 or the tube of the CRT. Thus, particularly, when the field emission array portion 51 is used as a cathode for an electron gun of a CRT, a substantial effect can be exerted in enhancing a long-life operation and a stable operation.

In each of the foregoing embodiments, an electron beam is incident on the electron lens portion in an off-axis state, and thus a beam spot of the electron beam may become asymmetric. Such asymmetry can be corrected by properly adjusting the design in terms of arrangement and shape of the electrodes as a part of the electrodes constituting the electron lens, for example, the grid electrodes G3 and G4.

The foregoing description was directed to a case where an electron source according to this embodiment is used in the CRT as a typical application. However, the applications of the present invention are not limited to the CRT. The present invention is also applicable to other applications, for example, in a high-luminance light-emitting display tube for field display, a light-emitting tube for illumination and the like.

The foregoing description was directed to the case of a single electron gun (monochrome CRT) with one field emission array portion and one electron lens portion for the ease of explanation. On the other hand, in the case of a color cathode ray tube device, an electron gun having three electron sources R, G, and B is used. In this case, for the respective field emission electron sources for forming three electron beams R, G and B, an off-axis arrangement is used. This allows a field emission array portion to be protected from ion impact caused by ions generated in each of electron lens portions, thereby achieving an improvement in life of the field emission electron source.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A field emission electron source, comprising:

a field emission array portion composed of an insulation layer with a plurality of apertures, which is formed on a substrate, an extraction electrode formed on the insulation layer, and a plurality of cathodes formed respectively on the substrate in the plurality of apertures;

a cathode base on which the field emission array portion is fixed; and an electron lens portion composed of a plurality of electrode members having a function of accelerating and converging an electron beam emitted from the field emission array portion, wherein an emission axis of the electron beam emitted from the field emission array portion has a predetermined angle with respect to an optical axis of the electron lens portion, the emission axis and optical axis being non-colinear.

2. The field emission electron source according to claim 1, wherein a cathode fixing surface inclined at the predetermined angle with respect to a surface of the cathode base is provided on a portion of the surface of the cathode base, and the field emission array portion is attached on the cathode fixing surface.

3. The field emission electron source according to claim 1, wherein a positioning mark is provided in either or both of a surface of the cathode base and a surface of the substrate.

4. The field emission electron source according to claim 1, wherein at least a part of the electron lens portion has a function of deflecting an angle of the emission axis of the electron beam emitted from the field emission array portion so that the angle of the emission axis coincides with the optical axis of the electron lens portion.

5. The field emission electron source according to claim 1, wherein an electron emitting region of the field emission array portion is disposed in a shielding region that faces a non-aperture region of a first electrode member among the plurality of electrode members constituting the electron lens portion, the first electrode member being arranged closest to the field emission array portion.

6. The field emission electron source according to claim 1, wherein an optical axis of an electrode member among the plurality of electrode members constituting the electron lens portion, the electrode member being arranged closest to the field emission array portion, has a predetermined angle with respect to the emission axis of the electron beam emitted from the field emission array portion.

7. An electron gun comprising a field emission electron source as claimed in claim 1.

8. A display device comprising a vacuum container, an electron gun having a field emission electron source, and a unit for deflecting an electron beam emitted from the electron gun, the electron gun and the unit being included in the vacuum container, wherein the field emission electron source comprises:

a field emission array portion composed of an insulation layer with a plurality of apertures, which is formed on a substrate, an extraction electrode formed on the insulation layer, and a plurality of cathodes formed respectively on the substrate in the plurality of apertures;

a cathode base on which the field emission array portion is fixed; and an electron lens portion composed of a plurality of electrode members having a function of accelerating and converging an electron beam emitted from the field emission array portion, wherein an emission axis of the electron beam emitted from the field emission array portion has a predetermined angle with respect to an optical axis of the electron lens portion, the emission axis and optical axis being non-colinear.

* * * * *